United States Patent [19]

Takada et al.

[11] 4,026,371

[45] May 31, 1977

[54] PILOT HEAD FOR LAYING PIPES IN THE GROUND

[75] Inventors: Hiroshi Takada, Yokohama; Yasuo Kawada, Isehara, both of Japan

[73] Assignee: Kabushiki Kaisha Komatsu Seisakusho, Tokyo, Japan

[22] Filed: Dec. 22, 1975

[21] Appl. No.: 643,118

[52] U.S. Cl. ..... 175/45; 175/19; 175/62; 175/61; 175/73

[51] Int. Cl.[2] ..... E21B 47/02

[58] Field of Search ..... 175/19–23, 175/45, 61, 62, 73, 92, 94, 98, 230; 299/31; 33/304

[56] References Cited

UNITED STATES PATENTS

| | | | |
|---|---|---|---|
| 2,874,936 | 2/1959 | Gonzales | 175/62 X |
| 3,326,008 | 6/1967 | Baran et al. | 175/19 X |
| 3,465,834 | 9/1969 | Southworth, Jr. | 175/73 |
| 3,468,133 | 9/1969 | Matsushita | 299/31 X |
| 3,506,310 | 4/1970 | Gruere | 175/62 X |
| 3,526,285 | 9/1970 | Adkins et al. | 175/62 X |
| 3,767,836 | 10/1973 | Geis et al. | 175/62 X |
| 3,857,449 | 12/1974 | Kimura | 175/45 X |

*Primary Examiner*—Ernest R. Purser
*Assistant Examiner*—Richard E. Favreau
*Attorney, Agent, or Firm*—Armstrong, Nikaido & Marmelstein

[57] ABSTRACT

There is disclosed a pilot head used for laying small-diameter pipes such as gas, water conduits or the like precisely in position in the ground. The pilot head comprises an expandable and contractable pilot jack disposed within a pilot casing, a pivoting cylinder adapted for pivoting said pilot jack in any selected direction in a plane normal to the central axis of the pilot head, and an electromagnetic valve for operating said cylinder. The pilot head further includes a target and a clinometer both for detecting the position and posture thereof.

9 Claims, 15 Drawing Figures

PILOT HEAD FOR LAYING PIPES IN THE GROUND

BACKGROUND OF THE INVENTION

This invention relates to a method and apparatus for laying pipes in the ground and, more particularly, to the laying-in of pipes such as drainage, gas, water pipes, or cables of a relatively small diameter.

One of the more common ways of laying pipes into the ground is that trenches are dug, the pipes are then placed in the trench, and finally the trench is filled with earth. When a relatively large land space is available, no difficulty with this method of laying-in of the pipes exists. However, various problems arise when digging trenches in roads is carried out in big cities where sufficient land spaces are not available. More specifically, for instance, pavement must be destroyed and the traffic is considerably obstructed in the course of construction.

Various attempts have heretofore been made to eliminate these problems by laying the pipes in the ground without digging the trenches. One such attempt has been to lay in the pipes when the excavated earth is discharged from the rear end of the laid-in pipes and another attempt has been to press the pipes into the ground upon consolidation of soil. A major difficulty with the first-mentioned attempt is that the scraped soil is removed from the rear end of the pipes by means for example of screw conveyors disposed within the pipes and, hence, the pipes are filled up with the scraped soil which is being discharged, with the results that the foremost point where the excavation is carried out can not be detected from a departure pit from which the pipes are laid in, and thus the straight advance of the laid-in pipes is difficult to be maintained. Furthermore, since the scraped soil is discharged into the departure pit, installation of a jack for pressing the pipes to be laid in, a control equipment and the like within the departure pit is limited, and earth hauling operation is interfered, thereby resulting in poor working efficiency. Later attempts to provide a detector pipe extending along the peripheral surface of and in parallel with the axis of the laid-in pipes so as to detect a vertical position of the front end of the laid-in pipes from the departure pit have met with only partial success, since these attempts have involved undesirable additional procedures to remove the detector pipe and to fill the space formed thereby with cement or the like, after the laying-in of the pipes is completed. Other difficulties occurring with the first-mentioned attempt are as follows: it is difficult to control the direction of advance of the laid-in pipes since the posture of the foremost, excavating point is unable to be detected and, hence, the operator must be skilled in ensuring that the pipes are advanced as straight as possible; the screw conveyor rotated in the laid-in pipes tends to damage the inner surface of the pipes; for this reason, the pipes to be laid in are in most cases limited to steel pipes as pipes of reinforced concrete are not suitable for this method; where it is absolutely necessary to use the pipes of reinforced concrete, steel pipes should be placed in the reinforced concrete pipes in order to prevent the inner surface of the latter from being damaged by the rotating screw conveyor; and there must be inserted the screw conveyor that fits with the internal diameter of the pipes, and this increases the cost of equipment because constructors must have a wide variation in types and forms of screw conveyors to accommodate many different sizes of pipes to be laid in.

A difficulty attendant with the other attempt to press the pipes into the ground upon consolidation of soil is that since the degree of consolidation of soil is increased as the laid-in pipes increase in diameter, considerably large apparatus become necessary in order to obtain a jack pressure large enough to press pipes of corresponding sizes into the ground.

According to another method, small-diameter pilot pipes are first pressed into the ground by a hydraulic jack, and large-diameter pipes are led by the pilot pipes and then laid in the ground. While this method is highly efficient, straight advancement of the laid-in pipes is not expected on account of the lack of control of the front end of the pilot head. The pilot pipes are followed by the large-diameter pipes which are laid-in upon consolidation of soil without excavating earth, and thus a relatively large consolidation pressure becomes necessary. This requires a considerably large-sized apparatus. In short, this latter method shares the common deficiencies with the foregoing prior art attempt which makes use of consolidation of soil.

SUMMARY OF THE INVENTION

In accordance with the invention, there is provided a pilot head capable of controlling its posture during the laying-in operation of pipes. The pilot head comprises a pilot head casing, an expandable and contractable pilot jack disposed within said casing, a pilot jack head secured to a front end of said pilot head and adapted for consolidation of soil, means for sealing said casing to prevent water or soil from entering said casing, and means for pivoting said pilot jack in any selected direction in a plane normal to the central axis of the pilot head, said last-mentioned means being disposed within a rear portion of said casing. The pilot head of this invention being capable of controlling its posture, can lay the pipes precisely in position in the ground.

It is an object of the invention to provide a pilot head used for laying pipes accurately in position in the ground.

Another object of the invention is the provision of a pilot head capable of controlling its posture.

Other objects, features and advantages of the present invention will be readily apparent from the following description taken in conjunction with the accompanying drawings.

BRIEF DESCRIPTION OF THE DRAWINGS

FIGS. 6–1 through 6–4 are enlarged views illustrating successive steps of operation relative to the direction correction of the pilot head;

DETAILED DESCRIPTION OF THE PREFERRED EMBODIMENT

Figure 1:
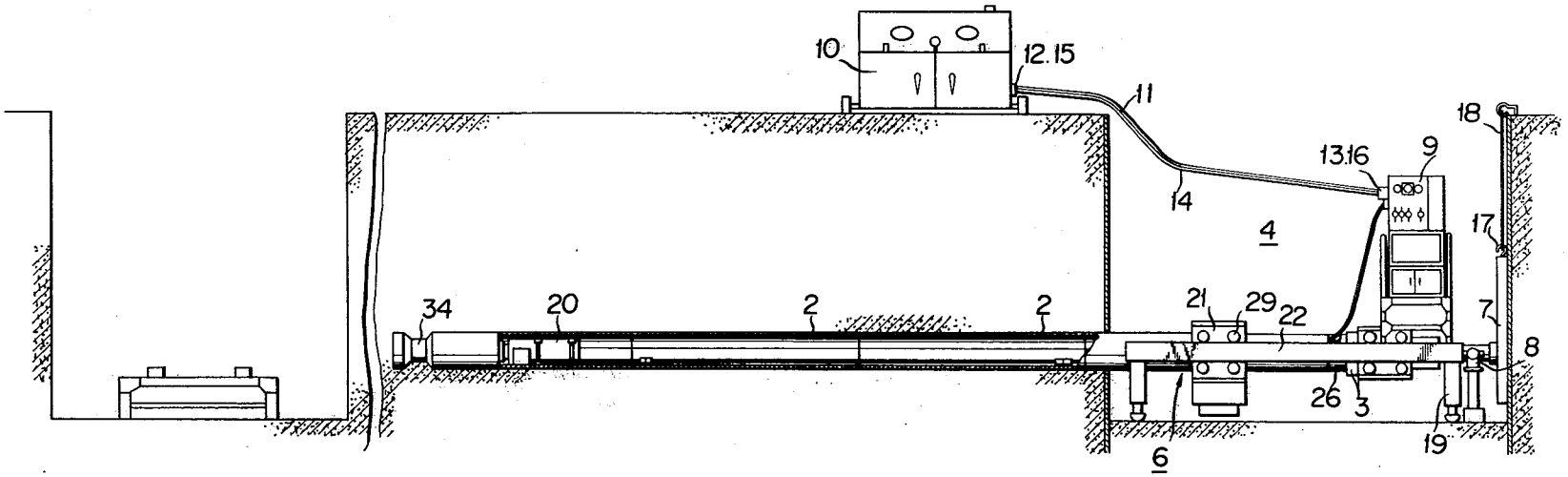
FIG. 1 is a schematic elevational view explanatory of the way in which pilot pipes are laid into the ground in accordance with a method of the invention.

In FIG. 1, there are shown a pilot head 1 and pilot pipes 2 connected in following relation to the pilot head 1, the pilot head 1 and the pilot pipes 2 being pressed into the ground by a propulsion jack 3. The pilot pipes 2 are propelled from a departure pit 4 until a foremost pipe 2 reaches an arrivel pit 5.

The departure pit 4 has therein a propulsion device 6, a reaction plate 7, a transit 8 and a control unit 9. The control unit 9 is operated by the operator to control the overall operation.

On the ground surface above the departure 4, there is provided a power source 10 from which an oil pressure is supplied through a hydraulic rubber hose 11 to control unit 9. The hydraulic rubber hose 11 has at the both ends a pair of connectors 12, 13 to facilitate connection with power source 10 and the control unit 9. Electric power is supplied through the power source 10 and an electric cable 14 to the control unit 9. The electric cable 14 has at the both ends a pair of connectors 15, 16 to facilitate connection with the power source 10 and the control unit 9.

Where the length of one hydraulic rubber hose 11 or one electric cable 14 comes short of the depth of the departure pit 4, additional hoses or cables of the same size can be used so as to increase the overall length of the combined hoses or cables.

The reaction plate 7 has at its top a hanging hook 17 to which there is connected a wire 18 extending from the top of a sheathing board 13, thereby hanging the reaction plate 7.

Four legs 19 is provided beneath the propulsion device 6, the legs 19 being vertically extensible by hydraulic pressure so that the propulsion device 6 can be maintained at a given height and grade. The hydraulic pressure is of course supplied from the control unit 9.

A transit 8 (this may be a laser transit or a laser beam emitter) is provided on the bottom of the departure pit 4 and is positioned slightly forwardly of the reaction plate 7, the transit 8 being so arranged at a given position and grade as to be able to measure a target 20 located at the rear end of the pilot head 1. A pipe support 21 has pipe supporting rollers the height of which is adjustable by a jack in order to maintain a pipe at a given elevation when the pipe is placed on the supporting rollers.

Figure 2:
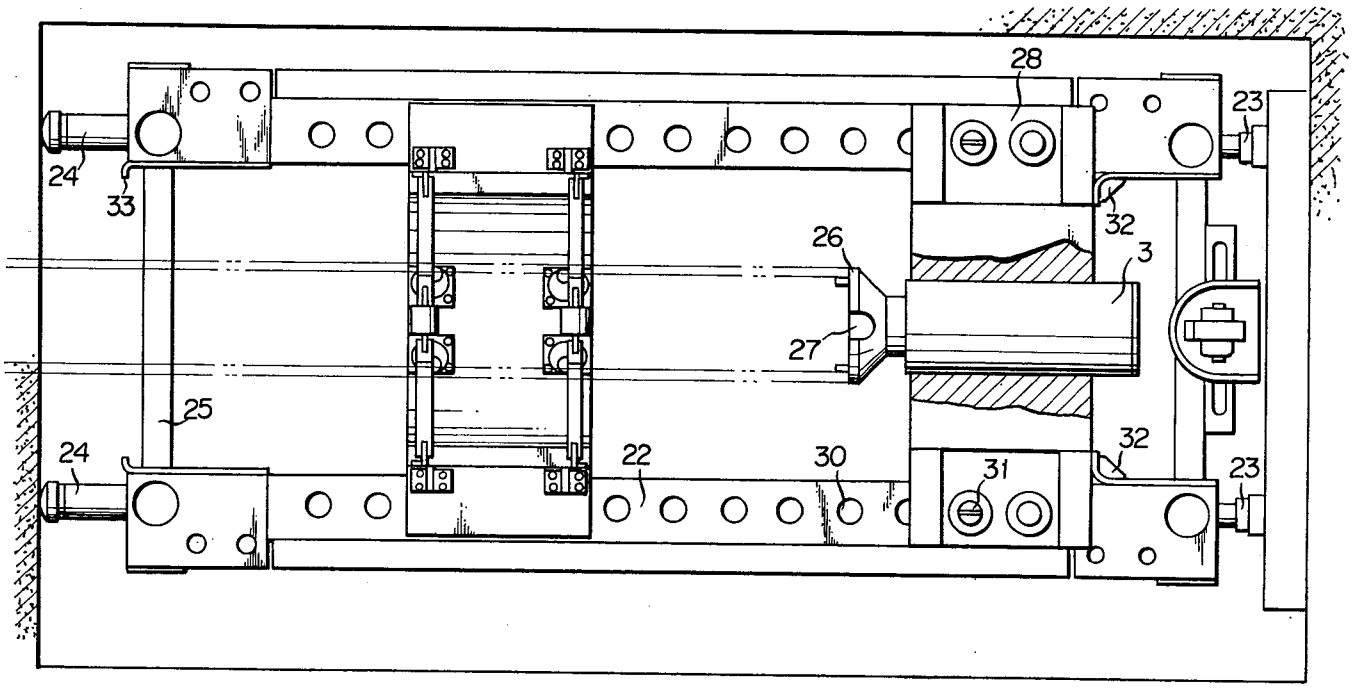
FIG. 2 is a plan view of a pipe propulsion device.
Figure 3:
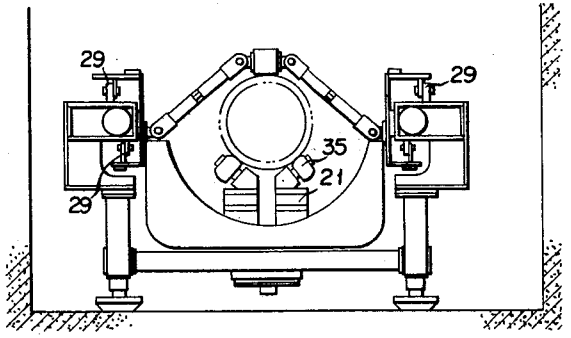
FIG. 3 is a left-hand side elevational view of FIG. 2.

As shown in FIGS. 2 and 3, the propulsion device 6 comprises a pair of rails 22, the rail legs 19, the propulsion jack 3, the pipe support 21, a pair of equalizing jacks 23 located rearwardly of the rails 22, and a pair of turnbuckles 24 located forwardly of the rails 22. The rail legs 19 extend downwardly in a direction normal to a plane in which the two parallel rails 22 lie, the legs 19 being connected by a pair of channels 25 to form the rails 22 integrally with each other. The rails 22 installed in the departure pit 4 extend in parallel with the direction of advance of the propelled pipes. As described before, the height and grade of the rails 22 is established by changing the length of the four adjustable rail legs 19. A propulsion adapter 26 is attached to the front end of the propulsion jack 3, the adapter 26 having parts suitable in shape for fitting with the pilot pipes 2. The propulsion adapter 26 has a cutaway recess 27 through which there are passed the hydraulic rubber hose 11 and the electric cable 14 that lead from the pilot head 1. The front end of the adapter 26 has its outside diameter smaller than the diameter of the rear end of the pilot head and of the pilot pipes such that the adapter is prevented from slipping away from the pilot and the pilot pipes. The adapter 26 has a pair of bosses 36 (FIG. 4) which are bolted to a pair of bosses 37 (FIG. 4) of the pilot head or the pilot pipes. The propulsion jack 3 is placed on the two rails with propulsion jack brackets 28 interposed therebetween. The propulsion jack 3 mounted on the propulsion jack bracket 28 is movable on the rails forwardly and rearwardly in the direction of advance of the pipes by means of rollers 29 mounted on the brackets 28, but is not movable vertically and laterally. The propulsion jack 3 is secured to the rails 22 by inserting pins 31 into registered pin-receiving holes 30 which are formed in the rails 22 and the propulsion jack brackets 28. The distance of any adjacent holes 30 in the rails is made smaller than the full stroke of the propulsion jack. When the propulsion jack secured at a given position to the rails is extended the full stroke, then the pins 31 are removed and the propulsion jack is contracted the full stroke. Thereafter, the propulsion jack 3 is shifted forwardly on the rails and the pins 31 are inserted again, when the propulsion jack is ready for the next propulsion. This operation is repeated so as to move the propulsion jack brackets 28 forwardly in an intermittent step-like manner. Upon the completion of proplusion of the entire length of the pipe 2 to be laid in, the propulsion jack is manually returned to rear stoppers 32, whereupon a next pipe may be set and likewise propelled. The rails are pressed against the reaction plate 7 through the equalizing jacks 23. The reaction force that the propulsion jack 3 creates during the pipe propulsion acts through the propulsion jack brackets 28, the pins 31, the rails 22 and the equalizing jacks 23 at the rear ends of the rails against the reaction plate 7. The propulsion jack 3 and the propulsion jack adapter 26 have axial bores through which the interior of the laid-in pipes can be viewed from the rear end of the propulsion device. Thus, as shown in FIG. 1, the target 20 in the pilot head 1 can be measured by the transit 8 set previously in a datum position and direction for the pipe laying-in at a position adjacent the reaction plate 7 in order to determine the position and tilt of the pilot head for the direction control of the latter.

The pipe support 21 is vertically movable by a hydraulic jack to raise or lower a pair of pipe-supporting rollers 35 until the axis of the pipes to be laid in which may be of different sizes and are placed on the rollers 35 becomes aligned with that of the propulsion jack. Since the pipe support 21 is shiftable on and along the rails with a pipe being supported thereon, the pipe support 21 may be moved to an any selected position whereupon a pipe to be laid in can be set thereon and can be propelled by the propulsion jack. With the pipe support 21 supporting the pipe via the rollers 35, after the pipe support 21 is moved to the stoppers 32 on the rails, the pipe can only be moved forwardly without the movement of the pipe support 21. Accordingly, the setting operation of the pipes can be made with ease and the pipes can be supported on the propulsion device 6 until the completion of laying of the pipes into the ground.

The rails 22 of the propulsion device are immovably supported by the turnbuckles 24 held against the front wall of the departure pit and by the equalizing jacks 23 held against the rear wall of the departure pit through the reaction plate 7. A jack-extending side of the cylinder of the equalizing jacks 23 is arranged to be supplied with the same hydraulic pressure as the propulsion jack 3. Each of the two equalizing jacks has the jack-extending cylinder side with an area against which the pressure acts being slighlty larger than half of a pressure-acting area in a jack-extending cylinder side of the propulsion jack 3. Assuming that a propulsion force acting on the propulsion jack 3 is F, F acts through the rails on the two equalizing jacks 23, and with the arrangement described above, the equalizing jacks 23 are subject to a force of $F+\alpha$ (the force $\alpha$ is small in comparison with F). Thus, the propulsion rails 22 are pressed against the rear wall of the departure pit by the two equalizing jacks 23 developing the force $\alpha$, so that the propulsion device can be held stationary.

Normally, the rear wall of the departure pit is formed by placing sheet piles or concrete in order to withstand the reaction force from the propulsion jack 3. Practically, the propulsion rails are very difficult to be maintained stationary and thus tend to become displaced when the propulsion force is exerted. According to the invention, the displaced amount is absorbed by the extensible and contractable equalizing jacks 23 thereby maintaining the propulsion rails 22 in a fixed position.

The front ends of the propulsion rails are adapted to be pressed against the front surface of the departure pit through the turnbuckles 24 attached to the front ends of the propulsion rails, the turnbuckles 24 being arranged to withstand a retracting force which is created during the retraction and re-propulsion of the pilot head, as hereafter described.

The equalizing jacks 23 and the turnbuckles 24 can be removed and attached with ease, and the jacks and the turnbuckles can be replaced with each other in position. More specifically, the pipe arrangement for the equalizing jacks 23 is removed and then the stoppers 32 which serve as covers for the propulsion rails are removed to take out the equalizing jacks 23. Likewise, covers 33 on the front end of the propulsion rails are detached to take out the turnbuckles 24. The equalizing jacks 23 and the turnbuckles 24 are replaced with each other in position and the covers are attached as before. When it is necessary to change the direction of propulsion of the propulsion jack 3, the latter is reversed in its longitudinal direction by detaching and attaching the propulsion jack brackets 28. More specifically, the propulsion jack 3 and the propulsion jack brackets 28 are separated from each other by removing bolts which connect these members together. After the propulsion jack 3 is removed, the pins 31 are detached and then the two opposed propulsion jack brackets 28 placed on the propulsion rails 22 is forced to slide along the inside of the rails and finally out of the rails. The pipe support 21 is moved on the propulsion rails 22 and the removed propulsion jack brackets 28 are reversed in the direction of propulsion, whereupon the brackets are secured to the rails 22 by the attachment pins 31. Then, the removed propulsion jack is reversed in its longitudinal direction and is inserted between the propulsion jack brackets 28. The propulsion jack 3 and the propulsion jack brackets 28 are securely bolted to each other. Locations at which the reaction plate 7 and the transit 8 are installed are changed, then the turnbuckles 24 are attached and the equalizing jacks 23 are piped. In this way, the direction of propulsion can be reversed without moving the propulsion rails which have been installed in alignment with the direction of laying-in of the pipes. Thus, the direction of propulsion can be changed only by lifting the lightweight parts without employing a large-sized crane which would otherwise be required to lift the propulsion rails 22. With this arrangement, working efficiency can be enhanced manifold.

The steps of laying in the pilot pipes by propelling the pilot head will now be described. The pilot head 1 is first placed on the pipe support 21. Upon movement of an operation lever (not shown) to a hydraulically-operated valve in the control unit 9, a pilot jack 34 provided on the front portion of the pilot head is advanced and pressed into the ground by the distance of the full stroke of the jack. The operating lever is returned to its neutral position and another lever is operated, whereupon the rod of the propulsion jack 3 is advanced to press the pilot head into the ground. At this time, the pilot jack 31 is contracted by the pressing force of the pilot head 1. The reaction force during this operation acts against the reaction plate 7 through the pins 31, the rails 22, and the equalizing jacks 23 located at the rear ends of the rails.

When the rod of the propulsion jack 3 is extended to the end of its stroke, the pins 31 is pulled up whereupon the lever is moved in the reverse direction in order to withdraw the rod. Since the rod of the propulsion jack 3 is bolted to the pilot head 1 via the adapter 26, the propulsion jack proper becomes advanced upon the advance of the pilot head. Then the pins 31 are inserted into and engaged with the pin-receiving holes in the propulsion jack bracket 28 and the holes in the rails, which holes are located forwardly of those which have previously received the pins. As before, the pilot jack 34 is first advanced and the propulsion jack 3 is then advanced. The pilot head is pressed into the ground by what might be called "multi-step propulsion."

When the pilot head is laid completely in the ground, the pins 31 engaging the propulsion jack bracket 28 with the rails 22 are pulled up, and then the propulsion jack 3 is manually or power-drivingly returned into abutment against the rear stoppers 32. The pipe support 21 is manually returned to a position substantially centrally between the rear end of the pilot head and the propulsion jack adapter 26.

The pilot pipe 2 to be laid in its place on the pipe-supporting rollers 35, whereupon a collar 38 (FIG. 5) is attached to the front end of the pilot pipe 2. The connectors 13, 16 of the hydraulic rubber hose 11 and the electric cable 14, respectively, are detached from the control unit 9, and then are passed through the pilot pipe 2 from the front end of the latter for connection with the control unit 9. The pilot pipe 2 is shifted on the pipe-supporting rollers 35 to insert the collar 38 into the rear end of the pilot head 1. The bosses 37 on the rear end of the pilot head and the bosses 37 on the front end of the pilot pipe are connected together by bolts 40 and nuts 41 with rubber washers 39 interposed therebetween.

By inserting the rubber washers 39, the pilot head and the pilot pipe are prevented from being rigidly interconnected, and this head-to-pipe connection can be bent vertically and horizontally as the rubber washer 39 is compressed. This connection is hereafter referred to as "loose-coupling."

Finally, the propulsion jack is manually moved until the adapter 26 coupled to the propulsion jack 3 abuts against the rear end of the pilot pipe 2, and then the pins 31 are inserted into the pin-receiving holes 30 so as to secure the propulsion jack to the rails.

In this way, the preparation of a next propulsion is completed. The pilot pipes 2 are then pressed into the ground through the multi-step propulsion using the propulsion jack 3 and the pilot jack 34.

When the front end of a first pilot pipe 2 has reached the arrival pit 5, the bolts and nuts connecting the bosses 37 together as well as the hydraulic rubber hose 11 and the electric cable connected to the rear end of the pilot head by connectors are removed. The pilot head is disconnected from the pilot pipe and is collected. Then, the hydraulic rubber hose 11 and the electric cable 14 are withdrawn at the departure pit, when the laying-in of the pilot pipes are completed.

A process of correcting the deflected direction of propulsion of the pilot head will now be described, which deflected direction of propulsion may be caused by unbalanced soil or stones during the laying-in of the pipes.

Figure 4:
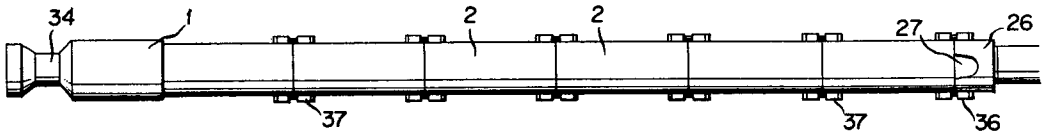
FIG. 4 is a schematic view explanatory of the way in which a pilot head and the pilot pipes are interconnected with each other.
Figures 1, 6:
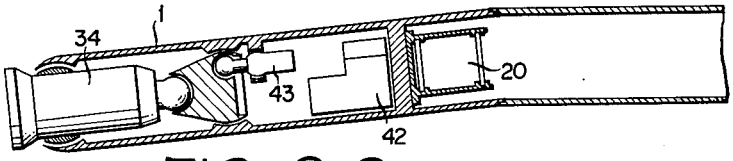
Figures 2, 6:
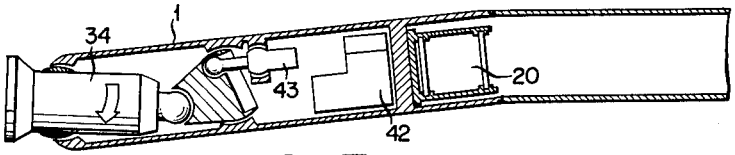
Figures 3, 6:
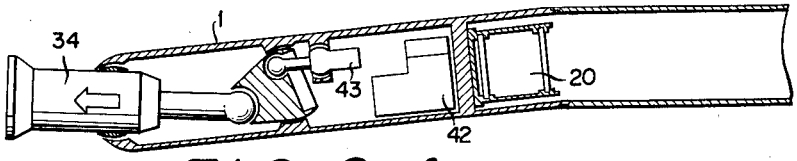
Figures 4, 6:
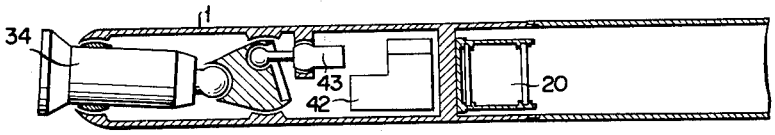

FIGS. 6–1 through 6–4 schematically shows successive steps in which the pilot head is operated to change its direction of advance.

FIG. 6–1 shows the pilot head deflected downwardly in its direction of propulsion under the influence of unbalanced soil, stones or the like. The deflection in the direction of propulsion can be read out by observing the target 20 in the pilot head through the transit 8 or by detecting an electric signal of a clinometer 42 at the control unit 9.

FIG. 6–2 shows the pilot jack 34 being swung by operating a cylinder 43.

Fig. 6–2 shows the pilot jack 34 being hydraulically advanced.

When the pilot jack 34 is advanced, the pressure acting on jack-extending side of the pilot jack cylinder is released. The pilot head and the pilot pipes are then advanced by the propulsion jack 3 in the departure pit 4, so that the pilot head proper is propelled forwardly as the pilot jack 34 is contracted on account of the soil abutting against the front surface of the pilot head. By repeating this operation, the pilot head proper is subject to a force tending to follow the pilot jack 34 and finally is returned to the correct position. In FIG. 6–4, the pilot head is maintained in its correct position. In this position, after the pilot jack 34 is horizontally advanced, the advance of the pilot head and the pilot pipes are repeated so that the pilot head can make its straight advance in a relatively stable manner. In accordance with this invention, the advance of the pilot head is less influenced by the unbalanced soil than the case where the pilot head is pressed into the ground by the propulsion jack without using the pilot jack.

There will now be discussed a process of correcting a high degree of deflection in the direction of propulsion of the pilot head, which deflection is unable to be recovered by the foregoing correction process.

Figure 5:
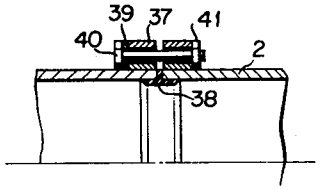
FIG. 5 is a fragmentary enlarged view showing the manner in which the pipes are interconnected.

The pilot head 1, the pilot pipes 2 and the propulsion jack 3 in the departure pit are interconnected by the bolts as shown in FIG. 4, so that the pilot head and the pilot pipes can be propelled or withdrawn by the propulsion jack 3 in the departure pit. The force created when the propulsion jack 3 in the departure pit withdraws the pilot head and the pilot pipes acts against the front wall of the departure wall though the propulsion rails 22. With this arrangement, when the pilot head is deflected from a desired direction of propulsion, the pilot head and the pilot pipes can be pulled back a certain distance, whereupon the direction of propulsion of pilot head can be corrected according to the foregoing process and then the pilot head and the pilot pipes can be propelled again. The pilot head 1 and pilot pipes 2 are bolted, but one or more bolt-connections as shown in FIG. 4 are made by means of the loose-couplings as shown in FIG. 5 which are different than tight-couplings at the other bolt-connections, so that the pilot head can maintain the ability of its direction control and at the same time can be withdrawn. The pilot pipes 2 which are tightly coupled and follow the loosely coupled pipes are propelled in the ground as a straight, rod-like member. This is advantageous in that it corrects and reduces meandering movement of the pilot head during its direction control operation, and is useful especially where drainage conduits are laid in when meandering disposition of the conduits is prohibited strictly.

Figure 7:
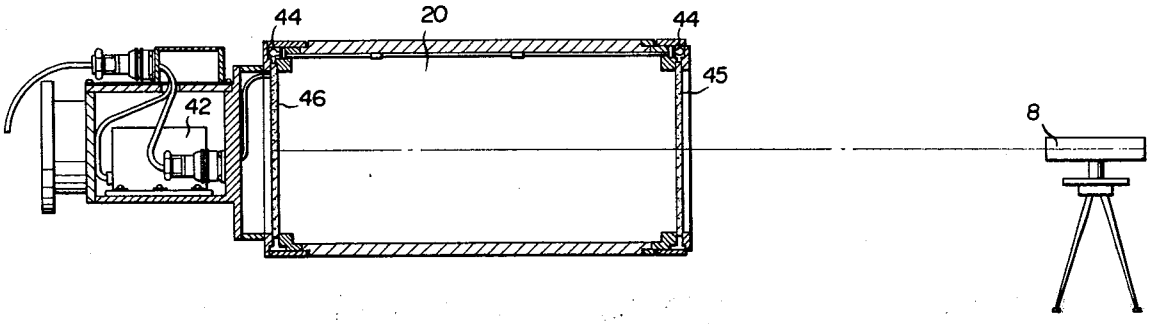
FIG. 7 is a schematic view showing the manner in which the position and posture of the pilot head are observed.

FIG. 7 is a schematic view showing in detail the target 20 and clinometer 42 for detecting the direction of the pilot head. The target 20 comprises a pair of indicia plates 45, 46 each made of a transparent plate such as a sheet of glass having indicia inscribed thereon, and a pair of lamps 44 for illuminating the indicia, the indicia plates being arranged perpendicularly to the axis of propulsion of the pilot head and being built in the casing of the pilot head. The center of the two indicia plates 45, 46 is positioned on the axis of propulsion of the pilot head. When the lamp 44 for the indicia plate 45 is turned off and at the same time the lamp 44 for the indicia 46 is turned on, the transit 8 set in registry with the datum line of propulsion within the departure pit can readily observe the indicia plate 46 since the indicia plate 45 is transparent. When it is necessary to observe the indicia plate 45, the lamp 44 for the indicia plate 46 is turned off and the lamp 44 for the indicia plate 45 is turned on. The displacement of the indicia plates 45, 46 from the datum line of propulsion is observed by the transit 8, according to which a tilt of the pilot head can easily be known by the calculation of trigonometric function. With the arrangement shown in FIG. 7, the position and tilt of the pilot head can be measured by the transit and, furthermore, a tilt of the pilot head in the vertical direction is electrically detected by the clinometer 42, the detected signal therefrom being transmitted through the electric cable to an indicator (not shown) in the departure pit, at which indicator the signal can be read out. With the use of the clinometer 42, there are no reading errors by the observation of the transit 8 and high-precision measurement is possible. The clinometer 42 is suitable particularly for drainage construction where high pipe laying-in precision is required in the direction of plane normal to the axis of the laid-in pipes. As another example of the target, there may be used an arrangement of the type having a convex lens at the leftwardly of the indicia plate 45 of FIG. 7 and a light spot position detector (not shown) in lieu of the indicia plate 46. The signal from the light spot position detector is amplified by an amplifier and can be read out at the indicator in the departure pit. By using a transit with a laser as the transit, the position of the indicia plate and the signal from the light spot position detector generated by the emission of a laser beam can simultaneously be read out. This arrangement makes it possible to measure at tilt angle of the pilot head with high precision where the pilot is propelled in the ground a long distance.

Figure 8:
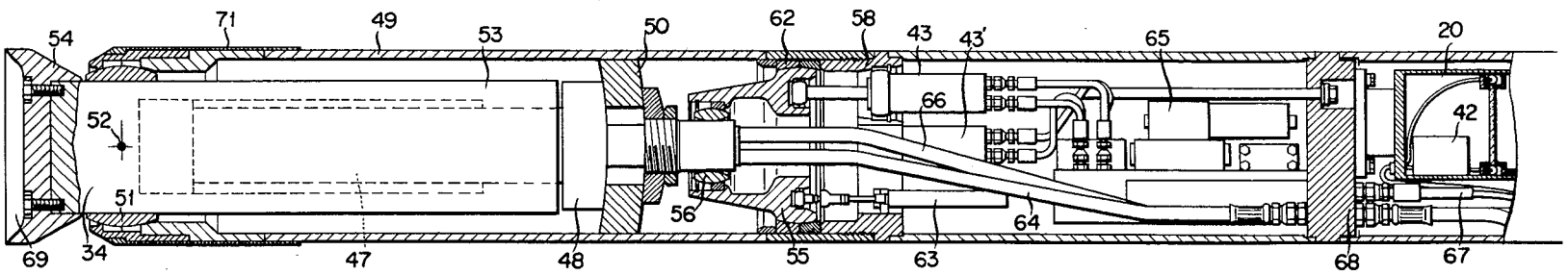
FIG. 8 is a longitudinal cross-sectional view of a pilot head constructed in accordance with the invention.

The structural details of the pilot head according to the invention, which head is used in the foregoing process of laying the pilot pipes in the ground, will now be described in detail. In FIG. 8, the pilot head has at its front portion a pilot jack 34 employed for consolidation of soil. A rod 47 of the pilot jack 34 has its rear portion fixed to a flange 48 having a spherical seat. The flange 48 is held in abutment against a partition 50 in a pilot head casing 49, and the partition 50 receives the reaction force from a propulsion force by the pilot jack 34. The pilot jack 34 can move forwardly by the length of stroke of the jack. The pilot jack is adapted to pivot about a pivotal center 52 of a spherical bearing 51, and a cylinder 53 can be advanced or retracted while it is pivoted. The pilot head has its front portion completely sealed against inclusion of soil or water therein which would otherwise be possible by the advancing, retracting or pivoting movement of the cylinder. The pilot jack 34 has its front portion fixed to a head 54 used for consolidation of soil. The flange 48 provided at the rear portion of the pilot jack 34 and having the spherical seat is positioned centrally within the pilot head and is adapted to be pivoted in any selected radial direction of the pilot head proper by a link member 55 of a pivoting mechanism section via a spherical bearing 56.

Figure 9:
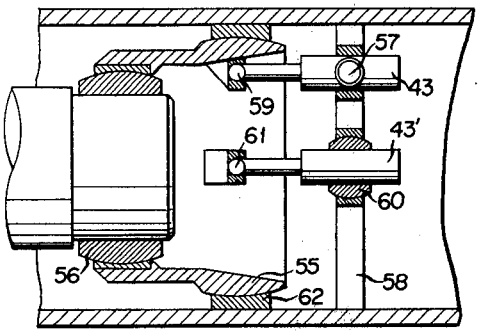
FIGS. 9 and 10 are schematic cross-sectional views explanatory of the way in which a pivoting cylinder and a link member are interconnected.

The structure of the pivoting mechanism section will be described with reference to FIG. 9. A pair of pivoting cylinders 43, 43' are disposed within the pilot head casig 49. The pivoting cylinder 43 has its support end connected to a partition 58 by a pin 57 and can be pivoted about the pin 57. The front end of the cylinder rod is coupled to the link member 55 via a spherical bearing 59. The pivoting cylinder 43' has its support end connected to the partition 58 and has the front end of the cylinder rod coupled to the link member 55 via spherical bearings 60, 61, respectively. The pivoting cylinders 43 and 43' are circumferentially spaced from each other by 90°. The link member 55 is mounted on the casing through a spherical bearing 62. The link member 55 is provided at its lever portion with a spherical bearing 56 having a concave surface against which the flange 48 of the pilot jack 34 is slidably held. When the pivoting cylinder 43 is expanded or contracted, the pilot jack 34 is pivoted vertically. When the pivoting cylinder 43' is expanded or contracted, the pilot jack 34 is pivoted horizontally. Between the link member 55 and the partition 58, there are provided two potentiometers 63 which are circumferentially spaced from each other by 90°, in order to measure the angle of inclination of the link member 55 to the partition 58. The outputs from the potentiometers 63 are available at a pivot angle indicating meter provided in the control unit 9 so that the angle of pivoting movement of the pilot jack 34 can be known on the ground.

Figure 10:
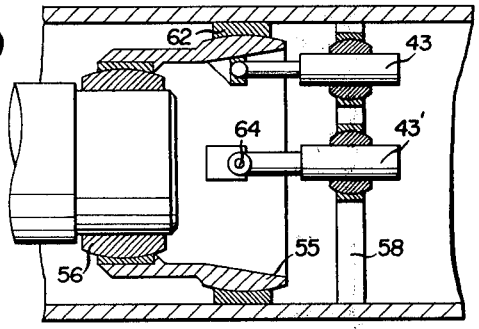

As shown in FIG. 10, the rod of the pivoting cylinder 43' may be coupled to the pivotal link 55 by a pin 64. The pivoting cylinders 43, 43' may be connected to the partition 58 and the link member 55 only by spherical bearings, and the link 55 may be arranged so that it will be pivoted and guided by a pin fixed thereto which moves in and along a groove provided in the spherical surface of the central partition 58 and extending in the propelling direction. The pivoting cylinders 43, 43' are supplied with oil under pressure though a hydraulic rubber hose 64 from the control unit 9 and are operated by actuating electromagnetic valves 65 provided in the pilot head proper. The electromagnetic valves 65 are provided correspondingly to the pivoting cylinders 43, 43' and are actuated by electromagnetic valve switches in the control unit 9 in the departure unit. Thus, in the departure unit 4, the valve switches can be depressed, the pivot angle of the pilot jack 34 can be known by the pivot angle indicating meter, and a desired pivot angle of the pilot jack can be established by remote control.

Figure 11:
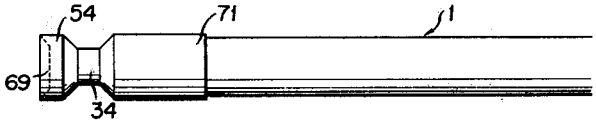
FIGS. 11 and 12 are schematic elevational views showing a front end portion of the pilot head.

The pilot head casing 49 is shielded at its front pilot jack spherical bearing and at an area with which the pilot jack slidably engages against inclusion of water and soil which would otherwise be done by the sliding and pivoting movements of the pilot jack. A hydraulic hose 66 for the pilot jack, the hydraulic hose 64 for the pivoting jack, and a cable 67 for supplying electric power to the electromagnetically switching valves for detecting the angle of pivoting movement, are all collected at a rear portion (forwardly of the target) of the pilot head proper in order to shield a portion of the pilot head extending between the pilot head front end and a connector block 68 at the rear portion against intrusion of water, soil or the like. The target 20 and the clinometer 42 are waterproofed themselves. Connector portions of the electric cable are also waterproofed. Thus, the pilot head being shielded from intrusion of water, soil or the like when propelled in the ground, can be freely operated and handled without being adversely influenced by environmental and soil conditions. Furthermore, the pilot jack front portion has a head so shaped that the pilot head will make its straight advance in a stable manner. More specifically, the pilot jack head 54 has at its front face a circumferential blade 69, as shown in FIG. 11. This shape of the pilot head is less adversely affected by unbalanced soil and stones in the ground and is more stable in assuring straight advance by a steering device than the conical shape of the pilot head.

Figure 12:
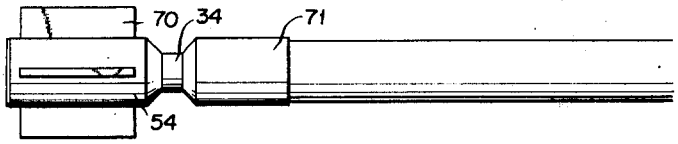

Under certain soil conditions, as shown in FIG. 12, the pilot head 54 can be replaced with a relatively long one having a plurality of plates (stabilizers) 70 mounted circumferentially thereon. This arrangement enhances a degree of straight advance of the pilot head when the latter is assumed to make straight advance (no angle of pivoting movement) and also amplifies a force tending to turn the pilot head when the latter is controlled to change its advancing direction (an angle of pivoting movement exists).

Furthermore, a collar 71 larger in diameter than the pilot head proper is fitted over a front portion of the pilot head. The collar 71 forms a hole in the ground as it is advanced, which hole is slightly larger in diameter than the pilot head proper and the following pipes to be pressed in. Thus, soil pressure exerted on the lateral surface of the head proper and the pressed-in pipes is extremely reduced so that frictional resistance by soil to the peripheral surface of the pressed-in pipes can be held to a minimum even when the overall length of the propelled pressed-in pipes is increased. As a consequence, a propulsion force by the propulsion jack 3 of the propulsion device in the departure pit can be reduced, and a load on the propulsion device, the rear wall of the departure pit and the reaction plate 7 can be decreased.

What is claimed is:

1. A pilot head for laying pipes in the ground comprising:

a pilot head casing;

an expandable and contractable pilot jack disposed within said casing;

a pilot jack head secured to a front end of said pilot jack for consolidating soil;

sealing means for preventing water or soil from entering said casing, said sealing means being provided between a front end of said casing and said pilot jack;

pivoting means for pivoting said pilot jack in any selected direction in a plane normal to the central axis of said pilot head, said pivoting means including a first pivoting cylinder, and a second pivoting cylinder circumferentially spaced in phase from said first cylinder by 90° said first and second cylinders being positioned at a rear portion of said casing, and;

electromagnetic valve means for remotely controlling said pivoting means, said electromagentic valve means being disposed in the rear portion of said casing.

2. A pilot head according to claim 1 in which said pilot jack is mounted on said casing via a first spherical bearing and is capable of pivoting about the pivotal center of the spherical bearing.

3. A pilot head according to claim 1 further comprising a collar means having a diameter greater than that of said pilot head casing secured to a front peripheral surface of said pilot head casing, for pushing out the soil surrounding said pilot head casing.

4. A pilot head according to claim 1 in which said first and second pivoting cylinders are mounted on said pilot jack via a link member.

5. A pilot head according to claim 4 in which said pilot jack, link member and pivoting cylinders are interconnected with each other by spherical bearings.

6. A pilot head according to claim 4 in which said link member and said first cylinder are interconnected with each other by a pin.

7. A pilot head according to claim 4 in which said link member and said second cylinder are interconnected with each other by a pin.

8. A pilot head according to claim 1 further comprising a pair of indicia plates extending perpendicularly to the axis of said casing and spaced from each other a predetermined distance, and means for illuminating each indicia plates independently, said plates and said means being disposed in a rear portion of said casing.

9. A pilot head according to claim 8 further comprising a tilt detector provided forwardly of said indicia plate and adapted to detect a pitch angle of said pilot head by the use of gravity.

* * * * *